United States Patent [19]

Harwath et al.

[11] Patent Number: 4,820,182

[45] Date of Patent: Apr. 11, 1989

[54] HERMAPHRODITIC L. I. F. MATING ELECTRICAL CONTACTS

[75] Inventors: Frank A. Harwath; Russell J. Leonard, both of Downers Grove, Ill.

[73] Assignee: Molex Incorporated, Lisle, Ill.

[21] Appl. No.: 134,635

[22] Filed: Dec. 18, 1987

[51] Int. Cl.[4] ..... H01R 13/28

[52] U.S. Cl. ..... 439/290; 439/291; 439/862

[58] Field of Search ..... 439/290, 291, 907, 287, 439/295, 889, 861, 862

[56] References Cited

U.S. PATENT DOCUMENTS

| | | | |
|---|---|---|---|
| 3,011,143 | 12/1961 | Dean | 439/291 |
| 3,072,340 | 1/1963 | Dean | 439/291 |
| 3,115,379 | 12/1963 | McKee | 439/290 |
| 3,414,865 | 12/1968 | Olsson | 439/290 |

*Primary Examiner*—Paula A. Austin

*Attorney, Agent, or Firm*—John W. Cornell; Louis A. Hecht

[57] ABSTRACT

A low insertion force mating electrical contact structure includes a pair of hermaphroditic terminals. Each hermaphroditic terminal is provided with dual cantilevered contact beams disposed in spaced parallel relationship and extending from a common base. The terminals are stamped from flat metallic material to provide each beam with a plurality of opposite but symmetrical bends relative to its initial central plane. The bends define rear and front contact surfaces on each beam and with rear and front cam surfaces leading into the respective contact surfaces. Identical hermaphroditic terminals as described can be mated with low insertion forces initially achieved by sliding cam interaction between the respective rear and front cam surfaces of two such terminals. The normal forces and deflection gradually increase as the terminals approach their fully mated condition. The rear and front contact surfaces move into sliding contacting relationship with desirably high normal forces at four distinct points of contact to achieve a high redundancy.

8 Claims, 2 Drawing Sheets

HERMAPHRODITIC L. I. F. MATING ELECTRICAL CONTACTS

BACKGROUND OF THE INVENTION

Electrical devices, such as computers, word processors and telecommunications equipment include components that are periodically removed to service or upgrade the equipment. Thus, the electrical connectors in such equipment are likely to be disconnected and reconnected many times.

Electrically conductive terminals and their nonconductive plastic housings that are likely to be disconnected and reconnected frequently should be designed to facilitate the proper alignment of the contacts during such reconnections by field personnel operating in relatively uncontrolled environments. Additionally, these terminals should be designed to minimize the possibility of damage from any misalignment of contacts that may occur. To this end, many computers and similar equipment include drawer connector housings which are intended to facilitate the alignment of the pairs of terminals mounted in the housings. In particular, the drawer connector housings may include matable pairs of mounting studs and hollow cylinders which engage prior to the initial engagement of the electrically conductive terminals. Thus, the telescoping movement of the mounting studs into the hollow cylinders will position and align the terminals mounted in the drawer connector housing.

Electrically conductive terminals and their housings that are likely to be repeatedly disconnected and reconnected may also be designed to achieve low insertion forces. In particular, these terminals are intended to avoid a high initial contact insertion force that could permanently deform or otherwise damage mating contact portions of the terminals.

It is often desirable to design electrically conductive terminals and their nonconductive housings to be hermaphroditic, such that two identical terminals and/or their housings are matable with one another. Hermaphroditically constructed terminals and housings can substantially reduce tooling costs and facilitate inventory management. Examples of hermaphroditic terminals that are intended to be repeatedly connected and disconnected are shown in U.S. Pat. No. 3,411,127 which issued to Adams on Nov. 12, 1968 and U.S. Pat. No. 3,414,865 which issued to Olsson on Dec. 3, 1968. The terminals in these two references each include a pair of offset contact arms with slightly arcuate or ramped leading ends which are adjacent to elongated generally planar contact surfaces. In the assembled condition of two such terminals, the elongated planar contact surface of one contact arm is disposed in face-to-face electrically contacting relationship with an elongated planar contact surface of the opposed hermaphroditic terminal.

Despite the many carefully engineered connector housings, such as drawer connector housings, slight misalignments of the very small contact members are possible. These misalignments may occur due to the tolerances of the various housing components, assembly errors or slight deformations of parts resulting from frequent disassemblies and reassemblies in the field. In many prior art terminals, these misalignments can damage the terminals and affect the quality of the connection.

In view of the above, it is an object of the subject invention to provide improved hermaphroditic terminals.

It is another object of the subject invention to provide hermaphroditic terminals that achieve both low insertion forces and high electrical contact forces without movable parts in their respective housings.

An additional object of the subject invention is to provide acceptably high electrical contact forces despite misalignments of the hermaphroditic terminals relative to one another.

It is a further object of the subject invention to provide hermaphroditic low insertion force terminals with multiple or redundant contact locations.

An additional object of the subject invention is to provide hermaphroditic terminals with plural camming lead-in surfaces to achieve low insertion forces.

Still a further object of the subject invention is to provide hermaphroditic terminals which gradually increase the contact forces as the contacts are urged into their fully mated conditions.

SUMMARY OF THE INVENTION

The subject invention is directed to a terminal having first and second leaf spring contact beams which are cantilevered from a common base. The cantilevered leaf spring contact beams may be generally parallel to one another with a longitudinal gap therebetween. However, the respective cantilevered leaf spring contact beams are of opposite bent configuration to be of hermaphroditic construction.

Each cantilevered leaf spring contact beam may be of double bend configuration, with a first bend extending to one side of the initial central plane of the contact beam and with the second bend extending generally to the opposite side of the initial central plane. The bends in each contact beam may be substantially symmetrical with respect to the initial central plane, but extend in opposite directions to achieve the hermaphroditic construction.

Each cantilevered leaf spring contact beam of the terminal comprises rearward and forward contact surfaces. In the assembled condition of a pair of the hermaphroditic terminals the rearward contact surface of a contact beam on one hermaphroditic terminal will engage the forward contact surface of a contact beam on the other hermaphroditic terminal. Each contact surface is provided with a camming radiused lead-in surface which is angularly aligned to the direction the contacts will move in approaching their mated condition. The respective camming surfaces are disposed and aligned to engage one another to achieve a low insertion force that will gradually increase as the hermaphroditic terminals approach their fully mated condition.

The rearward contact surface of each cantilevered leaf spring contact beam may be defined by a double bend to displace the rearward contact surface from the initial central plane of the terminal. In particular, the cantilevered leaf spring contact beam will bend a first direction from the base to extend away from the central plane of the base a selected amount, and then will bend in the opposite direction to cross the central plane angularly as the leaf spring contact beam extends away from the base. The portion of the leaf spring contact beam extending angularly across the central plane defines a rearward camming surface which leads with a radius into the rearward contact surface. The leaf spring contact beam undergoes a further bend such that its free end is directed back toward the central plane to define the forward contact surface. In particular, the forward contact surface may define the location on the leaf spring contact beam nearest the central plane and intermediate the rearward cam surface and the forward free end of the leaf spring contact beam. The leaf spring contact beam may undergo still a further bend away from the forward contact surface to define a radiused forward cam surface. Thus, a rearward cam surface on one hermaphroditic terminal will be engageable with the forward cam surface on a corresponding hermaphroditic terminal. The plural radiused cam surfaces ensure a low insertion force while the double bent configuration achieves a desirably high resilient normal contact force in the fully mated condition, to develop four independent and redundant contact locations.

As noted above, the cantilevered leaf spring contact beams are stamped from substantially flat metallic material and undergo plural generally symmetrical bends relative to the initial central plane of the leaf springs. Also as noted above, dimensional misalignments may be unavoidable in certain situations. The terminals of the subject invention are particularly tolerant of any such misalignment without significantly sacrificing the quality of the electrical connection. In particular, a misalignment between two hermaphroditic terminals of the subject invention in a direction perpendicular to the initial central plane of the leaf springs may decrease the contact forces between two mated leaf spring contact beams. However, the double bent configuration assures that a corresponding increase in contact forces will occur in the other pair of mated cantilevered leaf spring contact beams. Misalignments parallel to the initial plane of the cantilevered leaf springs will decrease the contact area somewhat but will have no substantial effect on the amount of contact force.

DETAILED DESCRIPTION OF THE PREFERRED EMBODIMENTS

Figure 1:
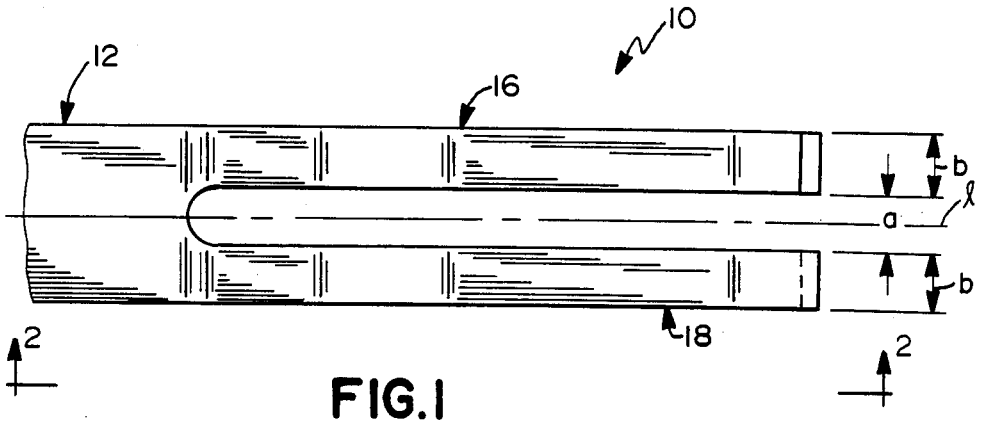
FIG. 1 is a top plan view of a terminal in accordance with the subject invention.
Figure 2:
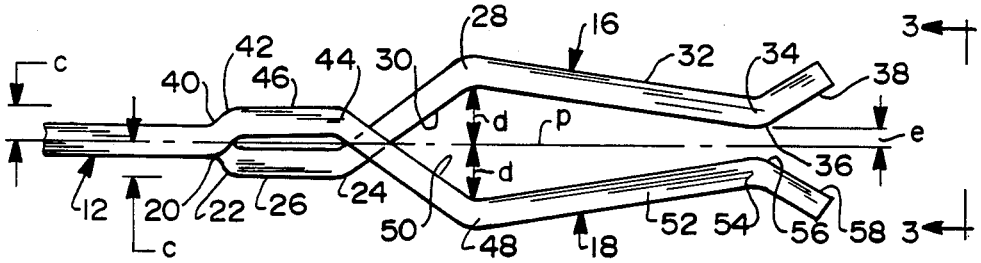
FIG. 2 is a side elevational view of the terminal shown in FIG. 1.
Figure 3:
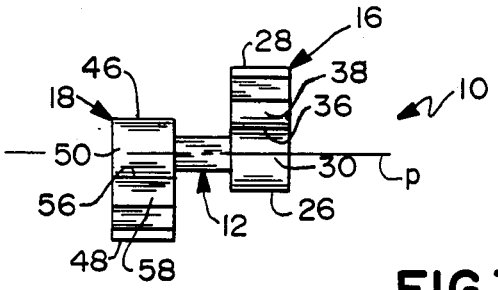
FIG. 3 is an end elevational view of the terminal shown in FIGS. 1 and 2.

The terminal of the subject invention is indicated generally by the numeral 10 in FIGS. 1–3. The terminal 10 is stamped from a flat metallic material to define a base 12 and a pair of cantilevered leaf spring beams 16 and 18 extending from the base 12. More particularly, the beams 16 and 18 from the top view as shown in FIG. 1 are substantially parallel to one another with a gap of dimension "a" therebetween. The beams 16 and 18 are of substantially identical width "b", and are symmetrical about the center line 1, of the terminal 10.

As shown more clearly in FIGS. 2 and 3, the beams 16 and 18 of terminal 10 are of multiple bend configuration relative to the plane "p" extending centrally through the base 12 of terminal 10. In particular, the beam 16 is stamped to undergo a first bend 20 away from central plane "p" substantially adjacent the base 12, and to undergo a second bend 22 substantially adjacent the bend 20 but in the opposite direction. A third bend 24 spaced from the bend 22 directs the beam 16 back toward and across the central plane "p". As a result of this construction, as shown most clearly in FIG. 2, a rearward contact surface 26 is defined intermediate the bends 22 and 24, with the rearward contact surface being approximately parallel to the plane "p" but offset therefrom by a distance "c".

The beam 16 extends from the radiused bend 24 across the central plane "p" to a fourth bend 28. A rearward cam surface 30 is defined between the bends 24 and 28 and on the same side of the beam 16 as the rearward contact surface 26. Thus, the rearward cam surface 30 with its radiused surface at bend 24 effectively lead into the rearward contact surface 26 as explained in greater detail below. The distance between the bends 24 and 28 is such that the interior corner of bend 28 is spaced from the center plane "p" by a distance "d" which exceeds the distance "c" by which the rearward contact surface 26 is spaced from the central plane "p".

The bend 28 is of a sufficient magnitude such that the portion 32 of the beam 16 extends back toward the plane "p". The beam 16 then is provided with a fifth bend 34 which extends away from the central plane "p" to define a forward contact surface 36 which is spaced from the central plane "p" by a distance "e". The length of portion 32 of the cantilevered beam 16 and the angular magnitude of bend 28 are selected such that the distance "e" between the forward contact surface 36 and central plane "p" is less than the distance "c" between the rearward contact surface 26 and the central plane "p". The portion of the beam 16 beyond the bend 36 is angularly aligned to the central plane "p" and radiused to define a forward cam surface 38. The rearward and forward cam surfaces 30 and 38 may define approximately equal angles to the central plane "p", as shown, so that they are approximately parallel, or the forward cam surface 38 may be more sharply angled to the central plane so that a radiused surface at bend 36 rides on rearward cam surface 30.

The second cantilevered contact beam 18 is similar to the first beam 16, but is bent in opposite directions such that the beams 16 and 18 are substantially symmetrical about the central plane "p". More particularly, the beam 18 includes a first bend 40 which directs the beam 18 away from the central plane "p" and a second bend 42 adjacent to the first bend 40 but in the opposite direction. A third bend 44 is spaced from the second bend 42 to define a rearward contact surface 46 therebetween on the side of the beam 18 opposite the central plane "p". The rearward contact surfaces 26 and 46 of the respective beams 16 and 18 are of substantially identical length and are disposed at substantially the same axial position along the terminal 10. Additionally, the rearward contact surface 46 is offset from the central plane "p" by a distance "c", which is substantially equal to the offset of the rearward contact surface 26 as explained above.

The bend 44 in the second contact beam 18 is of sufficient magnitude to direct the second contact beam 18 back toward and across the central plane "p" to a fourth bend 48. A rearward cam surface 50 of beam 18 is defined between the bends 44 and 48 and on the same side of beam 18 as the rearward contact surface 46 thereof. As with the first contact beam 16, the distance between the bends 44 and 48 on the second beam is such that the internal corner defined by bend 48 is spaced from the central plane "p" by a distance "d" which is greater than the distance "c" between the rearward contact surface 46 of beam 18 and the central plane "p".

The magnitude of bend 48 is such that the portion 52 of the second beam 18 extends back toward the central plane "p" to a fifth bend 54. The fifth bend 54 defines the forward contact surface 56 of the second beam 18. As noted previously, the magnitude of bend 48 and the length of portion 52 are such that the forward contact surface 56 is spaced from the central plane "p" by a distance "e" which is less than the distance "c" by which the rearward contact surface 26 is offset from the central plane. A forward cam surface 58 is defined on the second beam 18 adjacent the forward contact surface 56.

Figure 4:
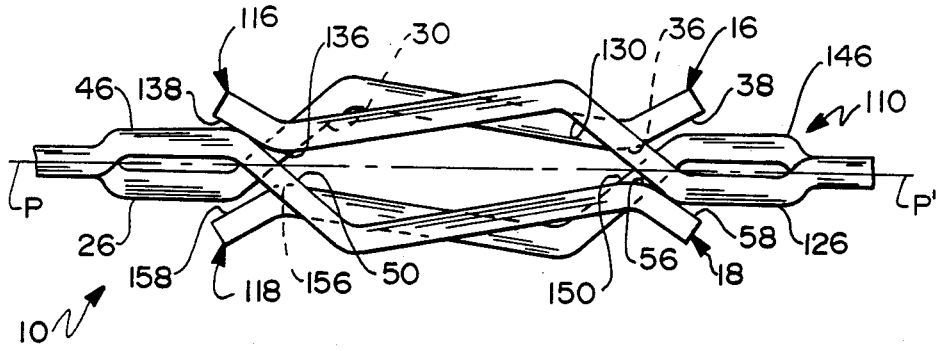
FIG. 4 is a side elevational view of a pair of terminals approaching a mated condition.
Figure 5:
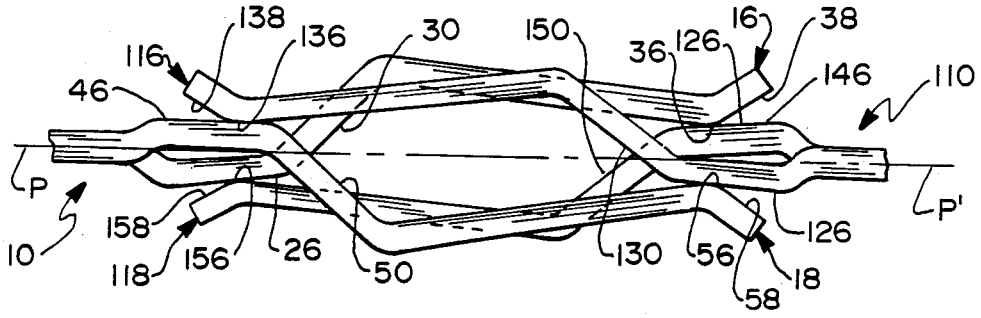
FIG. 5 is a side elevational view of a pair of terminals in a fully mated condition.

As shown in FIGS. 4 and 5, the hermaphroditic terminal 10 can be employed with a substantially identical terminal 110 to achieve a low insertion force but a high normal contact force in the fully mated condition of the substantially identical hermaphroditic terminals 10 and 110. In particular, the first beam 116 of terminal 110 will mate with the second beam 18 of terminal 10, while the first beam 16 of terminal 10 will mate with the second beam 118 of terminal 110. This mating is achieved by placing the terminals 10 and 110 in opposed relationship such that their central planes "p" and "p'" and their centerlines (not shown) are approximately aligned with one another. This initial approximate alignment typically would be achieved by an appropriate housing, such as a drawer housing. The terminals 10 and 110 will then be advanced axially toward one another into the partly mated condition as shown in FIG. 4. Although not specifically shown, it will be appreciated that the forward contact surface 56 of beam 18 will move past the forward contact surface 136 of beam 116 without direct contact, since the respective forward contact surfaces 58 and 136 are disposed on opposite sides of the approximately aligned central planes "p" and "p'". Continued movement of the terminals 10 and 110 will achieve the initial camming contact shown in FIG. 4. In this condition, the respective forward cam surfaces 38, 58, 138 and 158 will engage in a sliding camming action with the corresponding rearward cam surfaces 150, 130, 50 and 30 respectively. This sliding cam action is assured by the fact that the respective forward cam surfaces 36, 56, 136 and 156 are at a distance "e" from the central planes p and p' which is less than the distance "c" between the rearward contact surfaces 26, 46, 126 and 146 and the central planes p and p'. Furthermore, this sliding camming action achieved by the angular alignment of the respective radiused cam surfaces assures a low sliding insertion force.

Continued movement of the terminals 10 and 110 toward one another achieves the fully mated condition as shown in FIG. 5. In particular, the respective forward contact surfaces will be urged into sliding contact with the corresponding rearward contact surfaces 146, 126, 46 and 26. High quality redundant electrical connections are achieved at four independent points of contact by virtue of the sliding interaction and by the high normal forces achieved by the multiple bends described above and illustrated in the figures. In particular, each forward contact surface 36, 56, 136 and 156 is on a portion of the respective beam 16, 18, 116 and 118 which after plural bends is directed back toward the central plane p, p'.

As noted above, the configuration described above and illustrated in the figures is extremely tolerant of misalignment that may occur. In particular, with reference to FIGS. 4 and 5, a relative movement of either central plane p or p' will effectively reduce the amount of deflection placed in one pair of beams 16, 118 or 18, 116, with a corresponding reduction in normal forces. However, a corresponding increase in the deflection and normal forces in the other two beams 16, 118 or 18, 116 would result, thereby assuring plural high quality electrical connection even if the central planes p and p' are misaligned.

Similarly, misalignments relative to the central line and within the planes p and p' can be tolerated without significantly affecting either the insertion forces or the normal forces in the fully seated condition. In particular, as shown in FIG. 1, each beam 16 and 18 has generally flat contact and camming surfaces. Thus, despite side to side offset alignment relative to the central plane 1, contact will exist between mating terminals 10, 110. The limitation in such side to side misalignment is largely controlled by the width "b" of each beam 16, 18 of terminal 10.

In summary, an improved mating electrical contact structure is provided in a hermaphroditic terminal including dual cantilevered leaf spring contact beams. The terminal is stamped from generally flat metallic material with the two beams being in generally parallel spaced apart alignment and extending from a common base. Each beam undergoes a plurality of opposite bends relative to the central plane of the base such that the beams are substantially symmetrical around the central plane. In particular, the beams undergo a first series of bends to one side of the plane to define a rearward contact surface. The beams then bend back across the central plane to define rearward cam surfaces which lead with a radius into the rearward contact surfaces. Forward contact surfaces are defined at locations remote from the base and spaced from the central plane a distance less than the spacing between the rearward contact surfaces and the central plane. The extreme ends of each beam undergo further bends away from the central plane to define forward cam surfaces. Identical hermaphroditic terminals as described above are mated such that a low insertion force sliding camming interaction occurs between respective forward and rearward cam surfaces. This camming interaction results in a gradual deflection of the beams as the contact portions of the terminals approach their fully mated condition. In the fully mated condition, the respective rearward and forward contact surfaces achieve a sliding contact with high normal forces, and with a total of four independent points of electrical contact for each mated pair of hermaphroditic terminals.

While the invention has been described with respect to certain preferred embodiments, it is apparent that various changes can be made therein by those skilled in this art. For example, the bends at 24 or 44 between the rearward camming surfaces 30 and 50 and rearward contact surfaces 26 and 56, respectively, may be staggered with respect to each other in the axial direction. This would provide a rear contact surface on one beam which is longer than the other rearward contact surface on the other beam. Mating of two of these terminals so modified would further reduce the overall peak insertion force associated with mating because camming engagement of one pair of beams at a time would occur. The lifting components for each pair of beams would be instead of separated occurring simultaneously, which would tend to reduce the overall peak insertion force of the mated contacts. All such obvious modifications or changes may be made herein by those skilled in this art without departing from the scope of the invention as defined by the appended claims.

We claim:

1. A low insertion force mating electrical contact structure comprising: a pair of hermaphroditic terminals, each terminal including a base and two cantilevered contact beams unitary with and extending forwardly from said base, each said contact beam having a rear end adjacent said base and an opposed front end, said beams each including a plurality of bends such that said beams are disposed generally on opposite sides of a central plane, each beam further including:

a front cam surface adjacent the front end angularly aligned to said central plane;

a front contact surface intermediate said front cam surface and said rear end spaced from said central plane and defined on a surface of said beam facing toward the central plane;

a rear cam surface angularly aligned to said central plane intermediate said front contact surface and said rear end; and a rear contact surface intermediate said rear cam surface and said base extending parallel to and spaced from said central plane and defined on a surface of said beam facing away from the central plane, each terminal thereby including a pair of opposed front contact surfaces spaced at a first distance apart and a pair of opposed rear contact surfaces spaced at a second distance apart which is greater than said first distance apart, whereby, as the pair of terminals are mated, the front cam surfaces of each terminal slidingly engage the rear cam surfaces of the other terminal and the front contact surfaces of each terminal are gradually deflected away from the central plane from said first distance apart to said second distance apart until a final mated position is achieved wherein the front contact surfaces of each terminal are electrically engaged on the rear contact surfaces of the other terminal to provide four independent points of electrical contact between the mated terminals.

2. A mating contact structure as in claim 1, wherein each said rear cam surface intersects said central plane.

3. A mating contact structure as in claim 1, wherein the front and rear cam surfaces of each said contact beam are disposed at approximately equal angles to said central plane.

4. A mating contact structure as in claim 1, wherein each terminal is stamped and formed from generally flat metallic sheet metal stock.

5. A mating contact structure as in claim 1, wherein said front cam surface is spaced from and angularly aligned to said central plane such that the distance between said central plane and said front cam surface is greater at greater distances from said base.

6. A mating contact structure as in claim 1, wherein each of said contact beams is formed such that the distance between the central plane and the portion of said rear cam surface most distant from said base is greater than the distance between said central plane and said front contact surface.

7. A mating contact structure as in claim 1, wherein said contact beams are disposed in spaced-apart parallel relationship.

8. A mating contact structure as in claim 1, wherein the contact beams of each terminal are symmetrically bent with respect to one another on opposite sides of the central plane.

* * * * *